US008126352B2

(12) United States Patent
Ishikawa et al.

(10) Patent No.: US 8,126,352 B2
(45) Date of Patent: Feb. 28, 2012

(54) IMAGE FORMING APPARATUS AND DEVELOPER CARTRIDGE

(75) Inventors: Satoru Ishikawa, Kitanagoya (JP); Yukimi Nishikawa, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 587 days.

(21) Appl. No.: 12/056,656

(22) Filed: Mar. 27, 2008

(65) Prior Publication Data

US 2008/0240778 A1 Oct. 2, 2008

(30) Foreign Application Priority Data

Mar. 28, 2007 (JP) ..... 2007-085287

(51) Int. Cl.
*G03G 15/00* (2006.01)

(52) U.S. Cl. ..... 399/90

(58) Field of Classification Search ..... 399/90, 399/110, 111; 222/DIG. 1
See application file for complete search history.

(56) References Cited

U.S. PATENT DOCUMENTS 6,493,519 B2 12/2002 Sasame et al.
(Continued)

FOREIGN PATENT DOCUMENTS

JP 2001-215862 8/2001
(Continued)

OTHER PUBLICATIONS

JP Office Action dated Nov. 8, 2011, corresponding Application No. 2007-085287; English Translation.

*Primary Examiner* — David Gray
*Assistant Examiner* — Barnabas Fekete
(74) *Attorney, Agent, or Firm* — Banner & Witcoff, Ltd.

(57) ABSTRACT

An image forming apparatus includes an image carrier; a developing device configured to hold a developer carrier to supply developer to the image carrier, the developing device movable to a contacting position where the developer carrier contacts the image carrier and to a spaced position where the developer carrier is spaced from the image carrier; and a memory element disposed in the developing device. The developing device comprises: a pressing force input portion configured to receive pressing force to make the developer carrier contact the image carrier; and a spacing force input portion configured to receive spacing force to make the developing device move from the contacting position to the spaced position. At least one of the pressing force input portion and the spacing force input portion comprises a terminal electrically connected to the memory element.

17 Claims, 14 Drawing Sheets

U.S. PATENT DOCUMENTS

| | | | | |
|---|---|---|---|---|
| 6,714,745 | B2 | 3/2004 | Sasame et al. | |
| 6,751,428 | B2 | 6/2004 | Okabe | |
| 6,922,534 | B2 | 7/2005 | Goto et al. | |
| 7,174,117 | B2 | 2/2007 | Okabe | |
| 7,444,103 | B2 | 10/2008 | Okabe et al. | |
| 2002/0122672 | A1 * | 9/2002 | Sasago et al. | 399/12 |
| 2003/0123896 | A1 | 7/2003 | Goto et al. | |
| 2006/0210299 | A1 * | 9/2006 | Portig et al. | 399/90 |
| 2006/0285880 | A1 | 12/2006 | Okabe | |
| 2007/0036591 | A1 | 2/2007 | Okabe et al. | |
| 2007/0166070 | A1 * | 7/2007 | Sato | 399/90 |

FOREIGN PATENT DOCUMENTS

| | | |
|---|---|---|
| JP | 2003-084647 | 3/2003 |
| JP | 2004-037876 A | 2/2004 |
| JP | 2007-047481 A | 2/2007 |

* cited by examiner

IMAGE FORMING APPARATUS AND DEVELOPER CARTRIDGE

CROSS-REFERENCE TO RELATED APPLICATIONS

This application is based upon and claims the benefit of priority from Japanese Patent Application No. 2007-085287, filed on Mar. 28, 2007, the entire contents of which are incorporated herein by reference.

TECHNICAL FIELD

The present invention relates to an image forming apparatus such as a laser printer, and a developer cartridge mountable therein.

BACKGROUND

A process unit including a drum cartridge and developer cartridges is provided to an image forming apparatus such as a laser printer. In the drum cartridge, photosensitive drums are held. In the developer cartridges, toners are housed, and developing rollers to supply the toners to the photosensitive drums are held. In order for the developer cartridge to be replaceable with a new cartridge when toner in a developer cartridge runs out, the developer cartridge is removably mounted on the drum cartridge.

Among such types of image forming apparatuses, there is an image forming apparatus in which developing rollers are made capable of being pressed against and spaced from photosensitive drums (for example, see JP-A-2003-84647). In this image forming apparatus, during image formation, in order to satisfactorily transfer the toners to the photosensitive drums from the developing rollers, developer cartridges are pressed to make the developing rollers contact the photosensitive drums in a pressed state. On the other hand, during non-image formation, in order to prevent deformation and the like in the developing rollers by continuously pressing the same areas of the developing rollers by the photosensitive drums in non-rotating state, the developing rollers are spaced from the photosensitive drums.

Further, there is an image forming apparatus in which a memory is mounted on a cartridge removably mounted on the apparatus body, and information on history of image forming operations is recorded in the memory (for example, see JP-A-2001-215862).

However, in accordance with an image forming apparatus having a structure in which developing rollers are capable of being pressed against and spaced from photosensitive drums, the developer cartridge is moved in accordance with a pressing and spacing operation thereof. Therefore, when a memory is mounted on a developer cartridge, it is impossible to secure a connection between a terminal attached to the memory and terminals provided to the apparatus body, which makes it impossible to satisfactorily perform read/write of information to the memory.

SUMMARY

An object of one aspect of the present invention is to provide an image forming apparatus capable of satisfactorily carrying out read/write of information with respect to a memory element provided to the developing device in a structure in which a developing device is provided to be movable in order to make a developer carrier contact and be spaced with respect to an image carrier.

Further, an object of another aspect of the present invention is to provide a developer cartridge capable of satisfactorily carrying out read/write of information with respect to a memory element disposed in the case in a structure in which a case is provided to be movable in an image forming apparatus body in order to make a developer carrier contact and be spaced with respect to an image carrier.

According to a first aspect of the invention, there is provided an image forming apparatus comprising: an image carrier; a developing device configured to hold a developer carrier to supply developer to the image carrier, the developing device movable to a contacting position where the developer carrier contacts the image carrier and to a spaced position where the developer carrier is spaced from the image carrier; and a memory element disposed in the developing device, wherein the developing device comprises: a pressing force input portion configured to receive pressing force to make the developer carrier contact the image carrier; and a spacing force input portion configured to receive spacing force to make the developing device move from the contacting position to the spaced position, and wherein at least one of the pressing force input portion and the spacing force input portion comprises a terminal electrically connected to the memory element.

According to a second aspect of the invention, there is provided a developer cartridge removably mountable to an image forming apparatus having an image carrier, the developer cartridge comprising: a developer carrier configured to supply developer to the image carrier; a case that holds the developer carrier; a memory element disposed in the case; a pressing force input portion configured to receive pressing force to make the developer carrier contact the image carrier; and a spacing force input portion configured to receive spacing force to make the developer carrier be spaced from the image carrier, wherein at least one of the pressing force input portion and the spacing force input portion comprises a terminal electrically connected to the memory element.

BRIEF DESCRIPTION OF THE DRAWINGS

FIG. 6 shows a state in which outer covering plates and a front cover of the body casing are detached, and the drum unit is mounted into the body casing;

DESCRIPTION

1. Overall Configuration of Color Laser Printer

Figure 1:
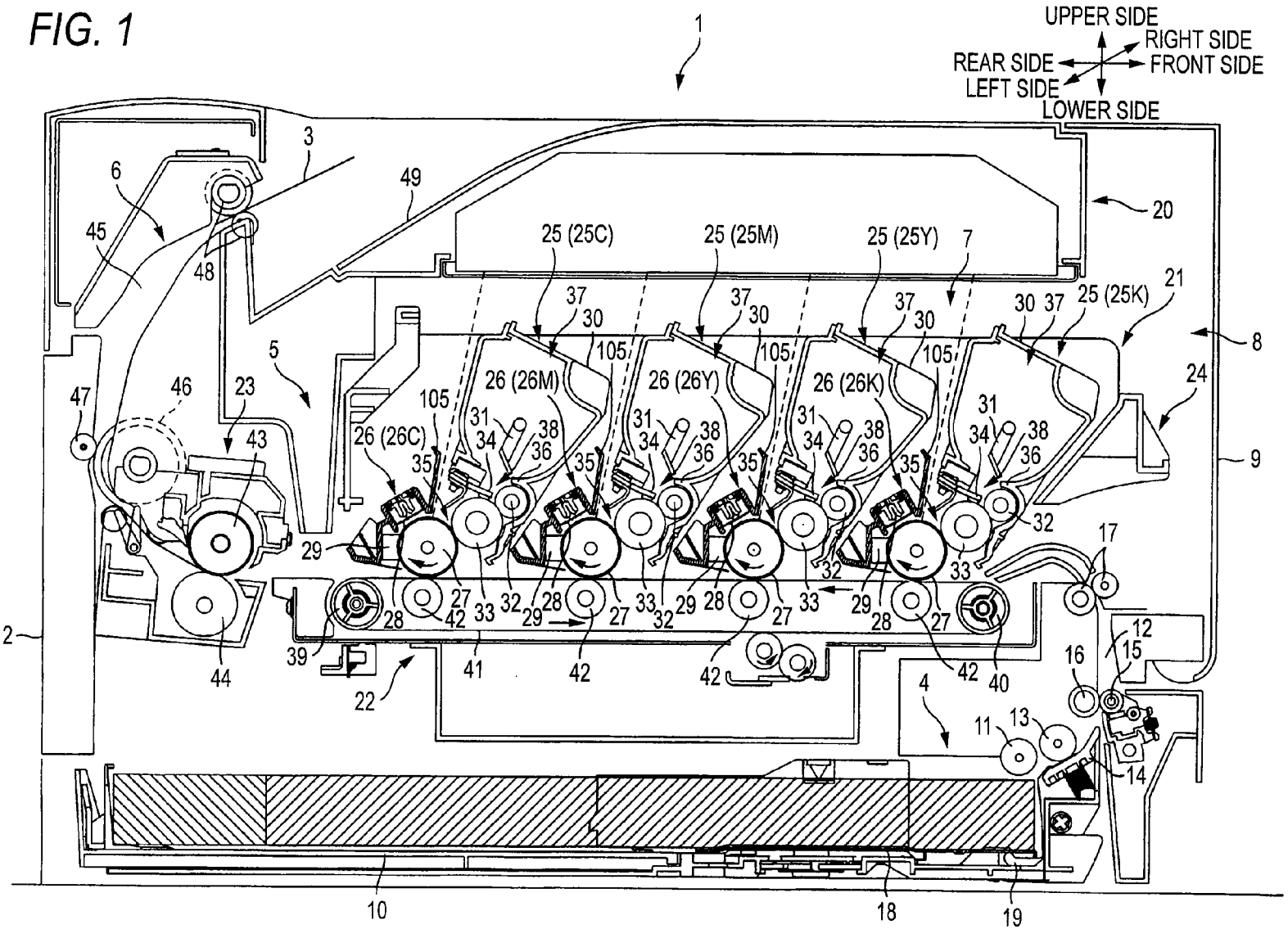
FIG. 1 is a sectional side view showing one embodiment of a color laser printer as an example of an image forming apparatus of the present invention.

FIG. 1 is a sectional side view showing one embodiment of a color laser printer as an example of an image forming apparatus of the present invention.

This color laser printer 1 is a transverse-mounted tandem type color laser printer in which a plurality of photosensitive drums 27 are disposed in parallel in a horizontal direction.

The color laser printer 1 includes a sheet feeding unit 4 to feed a sheet 3, an image forming unit 5 to form an image on the sheet 3 fed, and a sheet discharging unit 6 to discharge the sheet 3 on which the image has been formed, in a body casing 2.

(1) Body Casing

The body casing 2 is formed in a box shape whose side view is a substantially rectangular shape and defines therein a drum housing space 7 in which a drum unit 24 described later is housed.

An opening 8 communicated with the drum housing space 7 is formed at one side surface of the body casing 2. Further, a front cover 9 to open and close the opening 8 is provided at the side surface at which the opening 8 is formed. This front cover 9 is made to fall over to the side of the body casing 2 to open the opening 8, and is made to stand up along the one side surface of the body casing 2 to close the opening 8. In a state in which the opening 8 is open, the drum unit 24 can be mounted to and removed from the drum housing space 7 via the opening 8.

In addition, in the following descriptions, the side at which the front cover 9 is provided (on the right side in FIG. 1) is defined as a front side (front face side), and the opposite side (on the left side in FIG. 1) is defined as a rear side (back face side). Further, the view from the front side of the color laser printer 1 is defined as a standard for the right and left. With respect to the drum unit 24, unless there is a particular reference thereto, it will be described with a direction in a state in which the drum unit 24 is mounted in the body casing 2 as a standard.

(2) Sheet Feeding Unit

The sheet feeding unit 4 includes a sheet feeding tray 10 removably mounted on the bottom inside the body casing 2. A feed roller 11 is disposed above the front end of the sheet feeding tray 10. Further, the sheet feeding unit 4 includes a substantially U-shaped sheet feeding path 12 formed between the upper side of the front end of the sheet feeding tray 10 and a conveyor belt 41 described later. A separation roller 13, a separation pad 14, a pinch roller 15, a paper powder removing roller 16, and a pair of registration rollers 17 are allocated on the sheet feeding path 12.

The sheets 3 stuck at the sheet feeding tray 10 are sent out one by one to the sheet feeding path 12 by rotation of the feed roller 11. Each sheet 3 sent out is picked up between the separation roller 13 and the separation pad 14. Then, the sheet 3 passes through between the pinch roller 15 and the paper powder removing roller 16, and paper powder is removed by the paper powder removing roller 16. Thereafter, the sheet 3 is conveyed to the registration rollers 17. The registration rollers 17 send out the sheet 3 onto the conveyor belt 41 (described later) after registration.

(3) Image Forming Unit

The image forming unit 5 includes a scanner unit 20, a process unit 21, a transfer unit 22, and a fixing unit 23.

(3-1) Scanner Unit

The scanner unit 20 is disposed at the upper portion of the body casing 2. This scanner unit 20 includes optical members such as a laser, a mirror, a lens, and the like, and emits four laser beams at the four photosensitive drums 27 described later. As shown by the broken lines in FIG. 1, the surfaces of the photosensitive drums 27 are irradiated with the respective laser beams.

(3-2) Process Unit

The process unit 21 is disposed below the scanner unit 20 and above the sheet feeding unit 4. The process unit 21 includes the drum unit 24, and four developer cartridges 25 corresponding to the respective colors of black, yellow, magenta, and cyan.

The drum unit 24 is inserted from the opening 8 and provided to be slidable in a horizontal direction. This drum unit 24 includes four drum sub-units 26 corresponding to the respective colors.

The respective drum sub-units 26 are respectively disposed in parallel at intervals in an anteroposterior direction. That is, a black drum sub-unit 26K, a yellow drum sub-unit 26Y, a magenta drum sub-unit 26M, and a cyan drum sub-unit 26C are respectively disposed at intervals in this order from the front side to the rear side.

The respective drum sub-units 26 have the photosensitive drums 27, scorotron type electrifiers 28, and cleaning brushes 29.

The photosensitive drums 27 as an example of image carriers are disposed in a longitudinal direction, and are provided to be rotatable centering on those central axis lines.

The scorotron type electrifiers 28 are disposed to face the photosensitive drums 27 with a distance therebetween at the obliquely upward rear side of the photosensitive drums 27.

The cleaning brushes 29 are disposed so as to face to contact the photosensitive drums 27 at the back of the photosensitive drums 27.

The developer cartridges 25 as an example of a developing device are provided to correspond to the drum sub-units 26 of the respective colors as shown in FIG. 1. That is, a black developer cartridge 25K is provided to correspond to the black drum sub-unit 26K, a yellow developer cartridge 25Y is provided to correspond to the yellow drum sub-unit 26Y, a magenta developer cartridge 25M is provided to correspond to the magenta drum sub-unit 26M, and a cyan developer cartridge 25C is provided to correspond to the cyan drum sub-unit 26C.

Each of the respective developer cartridges 25 includes an agitator 31, a supply roller 32, a developing roller 33, and a layer thickness regulating blade 34 in the case 30.

The case 30 is formed in a box shape having opening portion 35 at the lower end. The inside of the case 30 is partitioned into toner housing chamber 37 at the upper side and development chamber 38 at the lower side by a partition wall 36.

The toner housing chamber 37 and the development chamber 38 are communicated with one another so as to be capable of supplying toner from the toner housing chamber 37 to the development chamber 38.

Toner of the color corresponding to the respective developer cartridge 25 is housed in the toner housing chamber 37. Positive charged polymerized toner including one nonmagnetic component in which respective coloring agent of yellow, magenta, cyan, and black is mixed so as to correspond to the respective color is used as toner of the respective color.

The agitator 31 is disposed in the toner housing chamber 37 and provided so as to be rotatable around an axis line extending in a longitudinal direction.

The supply roller 32 is disposed in the vicinities of the partition wall 36 in the development chamber 38.

The supply roller 32 as an example of developer carrier is disposed at the obliquely downward lower side of the supply roller 32 in the development chamber 38. A portion of the circumferential surface of the developing roller 33 is exposed from the opening portion 35 of the case 30.

The supply roller 32 and the developing roller 33 is provided so as to be rotatable around an axis line extending in a longitudinal direction. Further, the supply roller 32 and the developing roller 33 are pressed to contact each other with their circumferential surface.

The layer thickness regulating blade 34 is disposed in the development chamber 38. The layer thickness regulating blade 34 is structured such that a rubber member is provided to one end of a plate spring-shaped member made of metal, and the other end of the plate spring-shaped member is fixed to the case 30, and the rubber member is provided so as to press the developing roller 33 from above.

In the developer cartridge 25, the toner housed in the toner housing chamber 37 is discharged to the development chamber 38 while being agitated by the agitator 31. The toner discharged to the development chamber 38 is supplied to the supply roller 32. The toner supplied to the supply roller 32 is supplied to the developing roller 33 by rotation of the supply roller 32. At this time, the toner is frictionally electrified to have straight polarity between the supply roller 32 and the developing roller 33 to which developing bias is applied. Then, excess toner is scratched off from the developing roller 33 by the layer thickness regulating blade 34 in accordance with rotation of the developing roller 33, and thin layers of toner with a constant thickness is carried on the developing roller 33.

On the other hand, in the drum sub-unit 26 corresponding to the respective developer cartridge 25, the surface of the photosensitive drum 27 is positively charged uniformly by corona discharge of the scorotron type electrifier 28. Then, the surface of the photosensitive drum 27 having been positively charged is irradiated with laser beams from the scanner unit 20, which forms an electrostatic latent image corresponding to an image to be formed on the sheet 3.

When the electrostatic latent image formed on the surface of the photosensitive drum 27 is made to face the developing roller 33 by rotation of the photosensitive drum 27, the positively-charged toner carried on the surface of the developing roller 33 is supplied to the electrostatic latent image (i.e., a portion, which is exposed to the laser beams to lower their electric potential, of the surface of the photosensitive drum 27 positively-charged uniformly). In accordance therewith, the electrostatic latent image is made to be a visible image, and a toner image is carried on the surface of the photosensitive drum 27.

(3-3) Transfer Unit

The transfer unit 22 is disposed above the sheet feeding unit 4 and under the process unit 21 in the body casing 2. This transfer unit 22 includes a driving roller 39, a driven roller 40, the conveyor belt 41, and transfer rollers 42.

The driving roller 39 and the driven roller 40 are disposed to face one another with a distance in an anteroposterior direction. The conveyor belt 41 is made of an endless belt, and is wound around between the driving roller 39 and the driven roller 40.

When the driving roller 39 is rotated, the conveyor belt 41 revolves to move so as to rotate in a direction opposite to the photosensitive drums 27 at transfer positions facing to contact the respective photosensitive drums 27 between the driving roller 39 and the driven roller 40.

The transfer rollers 42 are respectively provided so as to face the respective photosensitive drums 27 with the conveyor belts 41 therebetween in the conveyor belt 41 wound around between the driving roller 39 and the driven roller 40. The respective transfer rollers 42 are provided so as to rotate by being driven in a direction the same as the direction of revolving movement of the conveyor belt 41 at the transfer positions facing to contact the conveyor belt 41.

The sheet 3 fed from the sheet feeding unit 4 is conveyed from the front side toward the rear side by the conveyor belt 41, and passes through sequentially the transfer positions corresponding to the respective photosensitive drums 27. Then, when the sheet 3 passes through the respective transfer positions, the toner images carried on the photosensitive drums 27 are transferred onto the sheet 3 by working of transfer biases applied to the transfer rollers 42. In accordance therewith, a color image is formed on the sheet 3.

In addition, transfer residual toners remaining on the photosensitive drums 27 after the transfer are recovered by the developing rollers 33. Further, paper powder from the sheet 3 adhered to the photosensitive drums 27 after the transfer is recovered by the cleaning brushes 29.

(3-4) Fixing Unit

The fixing unit 23 is disposed behind the transfer unit 22, and includes a heating roller 43 and a pressing roller 44 to press the heating roller 43.

In the fixing unit 23, the color image transferred to the sheet 3 is heat-fixed onto the sheet 3 by being heated and pressed while the sheet 3 passes through between the heating roller 43 and the pressing roller 44.

(4) Sheet Discharging Unit

The sheet discharging unit 6 includes a substantially C-shaped sheet discharging path 45 which is open frontward. On this sheet discharging path 45, a conveyor roller 46, a pinch roller 47, and a pair of discharge rollers 48 are allocated. The sheet 3 conveyed from the fixing unit 23 is conveyed along the sheet discharging path 45 by the conveyor roller 46 and the pinch roller 47, and is discharged onto a sheet discharging tray 49 formed at the superior surface of the body casing 2 by the discharge rollers 48.

2. Drum Unit

Figure 2:
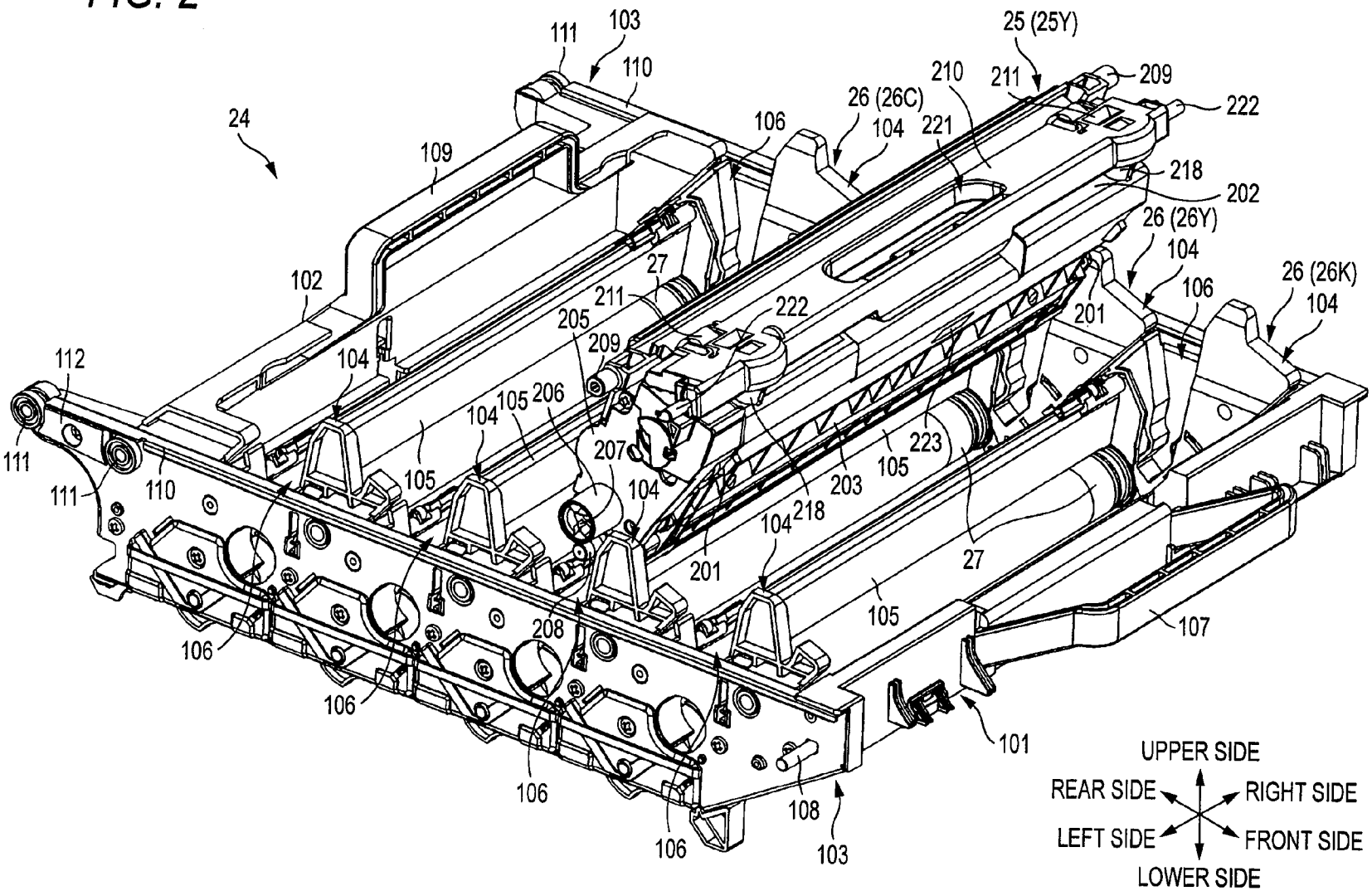
FIG. 2 is a perspective view of a drum unit shown in FIG. 1 and a developer cartridge in the process of being attached/detached with respect to the drum unit, which are viewed from the left front side thereof.

FIG. 2 is a perspective view of the drum unit 24 and the developer cartridge 25 in the process of being mounted and removed with respect to the drum unit 24, which are viewed from the left front side thereof.

The drum unit 24 includes a front beam 101 disposed at the front side of the four drum sub-units 26, a rear beam 102 disposed at the rear side of the four drum sub-units 26, and a pair of side plates 103 sandwiching the four drum sub-units 26, the front beam 101, and the rear beam 102 from the both sides in a longitudinal direction.

(1) Drum Sub-Unit

The drum sub-unit 26 has a pair of side frames 104 disposed to face one another with a distance in a longitudinal direction, and a center frame 105 provided to bridge in a longitudinal direction over the both side frames 104.

The respective side frames 104 are formed of resin material into flat plate shapes.

Guide slots 106 to guide the mounting and removal of the developer cartridge 25 with respect to the drum sub-unit 26 are formed to the respective side frames 104. The guide slots 106 are formed in a substantially vertical direction from the top edges at the rear sides of the side frames 104 up to the vicinities of the bottoms at the front sides of the side frames 104. Collar members 208 (described later) are slidably received into the guide slots 106.

The scorotron type electrifier 28 and the cleaning brush 29 (see FIG. 1) are held at the center frame 105.

(2) Front Beam

The front beam 101 is formed of a resin material.

This front beam 101 includes a near side gripper 107 attached to the central part in a longitudinal direction, and a supporting shaft 108 supporting the near side gripper 107.

The near side gripper 107 is formed into a shape whose front view is a substantially U-shape. The respective free ends of the near side gripper 107 are supported rotatably by the supporting shaft 108. In accordance therewith, it is possible to swing the near side gripper 107 to a housed position at which the near side gripper 107 stands up along the front beam 101, and to an operative position at which the near side gripper 107 is made to fall over to the front side of the front beam 101.

The supporting shaft 108 is disposed so as to run through the front beam 101 in a longitudinal direction, and is supported by the front beam 101. The both ends of the supporting shaft 108 run through the side plates 103 to project outward.

(3) Rear Beam

The rear beam 102 is formed of a resin material.

A back side gripper 109 is integrally formed at the central part in a longitudinal direction with the rear beam 102.

The back side gripper 109 is formed into a shape whose back view is a substantially U-shape, which projects upward from the rear beam 102.

(4) Side Plates

The respective side plates 103 are formed of steel plates. The respective side plates 103 are formed into shapes whose side views are substantially elongate rectangular plate shapes, which extend in an anteroposterior direction. Then, with respect to the respective side plates 103, the front ends thereof are fixed to the front beam 101, and the rear ends thereof are fixed to the rear beam 102. The respective side plates 103 hold the four drum sub-units 26 so as to sandwich those from the both sides.

The upper ends of the respective side plates 103 are bent outward into L-shapes on cross sections. In accordance therewith, flange portions 110 extending outward over the anteroposterior direction are formed at the upper ends of the respective side plates 103.

Further, the rear ends of the respective side plates 103 are formed into shapes whose upper ends extend backward and whose side views are substantially L-shapes. Then, two roller members 111 are provided rotatably to the portions extending backward therefrom. The two roller members 111 are disposed to place a spacer 112 therebetween in an anteroposterior direction. The roller member 111 at the front side is disposed under the flange portion 110. The roller member 111 at the rear side is disposed behind the rear end of the flange portion 110.

3. Developer Cartridge

Figure 3:
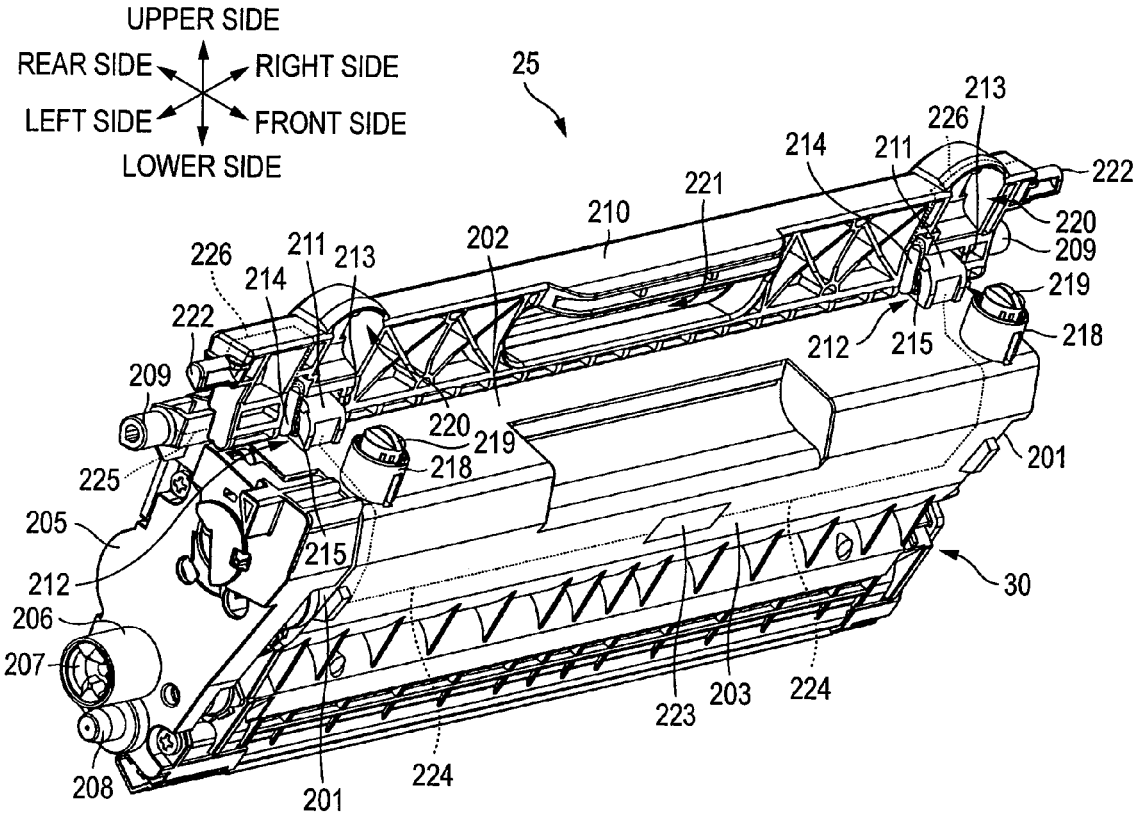
FIG. 3 is a perspective view of the developer cartridge shown in FIG. 2, which is viewed from the left front side thereof.
Figure 4:
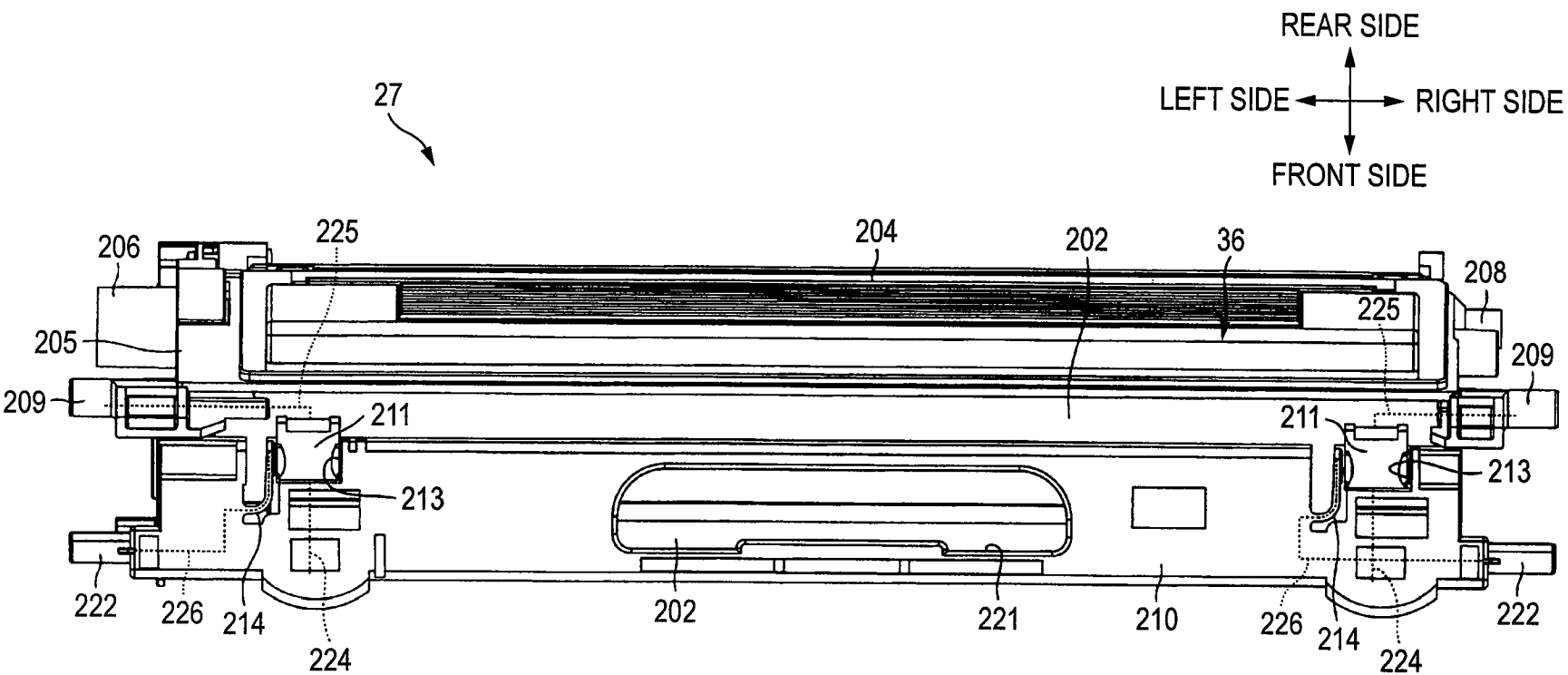
FIG. 4 is a plan view of the developer cartridge shown in FIG. 3.

FIG. 3 is a perspective view of the developer cartridge 25 viewed from the left front side thereof. Further, FIG. 4 is a plan view of the developer cartridge 25. In addition, in FIG. 4, the grip member is in a fallen over state.

(1) Developer Cartridge

The case 30 of the developer cartridge 25 integrally has a pair of side walls 201 facing one another in a longitudinal direction, an upper wall 202 provided to bridge between the top edges of the both side walls 201, a front wall 202 provided to bridge between the front edges of the both side walls 201, and a rear wall 204 provided to bridge between the rear edges of the both side walls 201 (see FIG. 4). The opening portion 35 (see FIG. 1) to expose the developing roller 33 is formed by the bottom edges of the side walls 201, the front wall 203, and the rear wall 204.

A gear cover 205 is attached to the side wall 201 on the left side. A cylindrical gear disposing portion 206 is formed to project on the gear cover 205. In the gear disposing portion 206, a passive gear 207 to which a coupling shaft (not shown) provided in the body casing 2 is coupled is disposed in the gear disposing portion 206. The agitator 31, the supply roller 32, and the developing roller 33 are made to rotate by driving force inputted to the passive gear 207 from the coupling shaft.

The shaft of the developing roller 33 runs through the gear cover 205 to project under the gear disposing portion 206, and the collar member 208 is attached to the leading end of the shaft. Further, the shaft of the developing roller 33 runs through the side wall 201 on the right side to project, and the collar member 208 (see FIG. 4) is attached to the leading end thereof as well. Substantially cylindrical spacing protrusions 209 projecting outward from the connecting portions with the upper end of the rear wall 204 are formed at the upper ends of the both side walls 201. The spacing protrusions 209 as an example of spacing force input portions are formed of conductive material.

A handle 210 gripped at the time of moving the developer cartridge 25 is provided to the upper wall 202. The handle 210 as an example of a grip member is formed in a laminar shape long in a longitudinal direction, and is provided to be capable of being swung to a standing state in which the handle 210 stands up to be substantially perpendicular to the upper wall 202, and to a fallen over state in which the handle 210 is made to fall over to the front side from the standing state to approach the upper wall 202.

Handle supporting portions 211 whose side views are substantially semicircular shapes, which project upward are integrally formed with the both ends of the rear end of the upper wall 202. As shown in FIG. 3, through holes 212 running through in a longitudinal direction are formed in the handle supporting portions 211 as an example of the shaft insertion portions. On the other hand, notch parts 213 into which the handle supporting portions 211 can be fitted are formed at the both ends of the rear end of the handle 210. Elastically deformable portions 214 whose plane views are substantially L-shapes, and in which the base ends are coupled to their left sides, are provided to the respective notch parts 213. With respect to the elastically deformable portions 214, free ends thereof face the right side surfaces of the notch parts 213 with a distance in a longitudinal direction, and the handle supporting portions 211 are fitted into between the free ends of the elastically deformable portions 214 and the right side surfaces of the notch parts 213. That is, each deformable portion 214 has one portion (an example of a fixed portion) fixed to the handle 210 at the notch part 213 and another portion (an example of a free portion) unfixed to the handle 210. Then, supporting shafts 215 (see FIG. 3) as an example of shafts are respectively provided to project in a direction coming close to one another at the free ends of the elastically deformable portions 214 and the right side surfaces of the notch parts 213. The supporting shafts 215 are formed of conductive material. In a state in which an interval between the supporting shafts 215 is broadened by deforming the elastically deformable portions 214, the handle supporting portions 211 are fitted into the respective notch parts 213. Thereafter, the deformation of the elastically deformable portions 214 is cancelled, and the respective supporting shafts 215 are inserted into the through holes 212 of the handle supporting portions 211, and therefore, the handle 210 is attached to the handle supporting portions 211 so as to be capable of being swung. The elastically deformable portion 214 and/or the supporting shaft 215 serves as an example of a second connecting portion.

Figure 5:
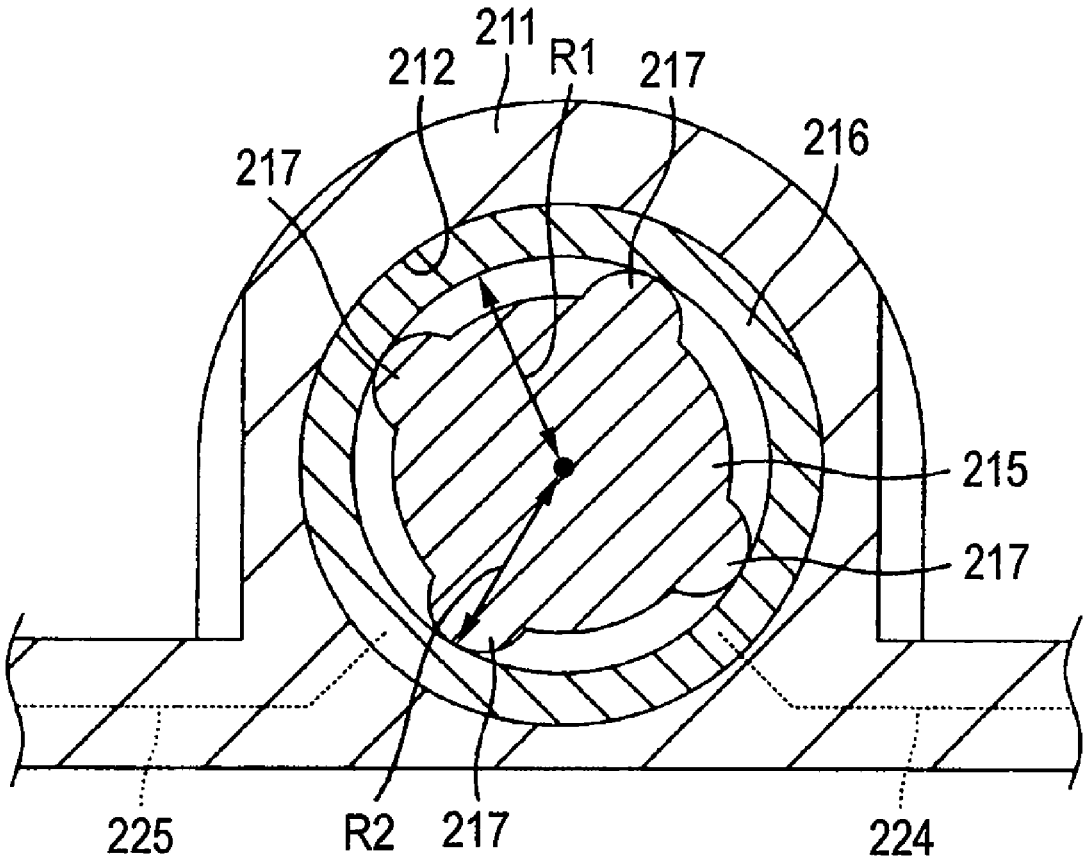
FIG. 5 is a cross-sectional view of a handle supporting part shown in FIG. 2.

FIG. 5 is a cross-sectional view of the handle supporting portion 211.

As shown in FIG. 5, a ring-shaped member 216 formed of a conductive shrinkable material is fitted to the inside of the through hole 212 of the handle supporting portion 211. The ring-shaped member 216 is formed of, for example, polyurethane rubber into which carbon black particles are added, silicon rubber, or the like. The handle supporting portion 211 and/or the ring-shaped member 216 serves as an example of a first connecting portion.

The supporting shaft 215 is inserted into the ring-shaped member 216. The radial of the supporting shaft 215 is formed to be smaller than an internal diameter R1 of the ring-shaped member 216, and gaps are formed between the circumferential surface of the supporting shaft 215 and the internal circumferential surface of the ring-shaped member 216. A plurality of protrusions 217 are formed integrally with the supporting shaft 215 on the circumferential surface of the supporting shaft 215. A height of each protrusion 217 (a volume of protrusion) is designed such that a length R2 from the center of the supporting shaft 215 to a tip of each protrusion 217 is made greater than the internal diameter R1 of the ring-shaped member 216. In accordance therewith, the respective protrusions 217 contact the internal circumferential surface of the ring-shaped member 216, and the supporting shaft 215 is supported rotatably with low resistance by the ring-shaped member 216, and is provided to be capable of having electrical continuity with the ring-shaped member 216.

As shown in FIG. 3, spring guide members 218 are formed at the both ends of the front end of the upper wall 202. The respective spring guide members 218 face the respective handle supporting portions 211 with a distance in an anteroposterior direction. Elastically contacting members 219 as an example of elastic members, which are capable of elastically moving forward and backward in a vertical direction are provided in the respective spring guide members 218.

Concave portions 220 capable of receiving the corresponding elastically contacting members 219 are formed at positions corresponding to the elastically contacting members 219 on the bottom surface of the handle 210 (a plane opposite to the upper wall 202). In a state in which the handle 210 is made to fall over into a fallen over state, the respective elastically contacting members 219 are received in the respective concave portions 220, and the leading ends of the respective elastically contacting members 219 contact the bottom surfaces of the respective concave portions 220 (the bottom of the handle 210).

Further, a grip hole 221 whose plane view is a substantially rectangular shape, which is long in a longitudinal direction, is formed at the central part in a longitudinal direction. In accordance therewith, it is possible to grip the handle 210 by inserting fingers into the grip hole 221.

Moreover, pressing protrusions 222 as an example of pressing force input portions, whose side views are substantially cylindrical shapes, are provided at the both ends of the front end of the handle 210. The respective pressing protrusions 222 are formed of conductive material. The respective pressing protrusions 222 are formed to have lengths such that the apical surfaces are located on the plane including the apical surfaces of the spacing protrusions 209 projecting to the same side. Further, the respective pressing protrusions 222 are disposed at positions lower than the spacing protrusions 209 in a state in which the developer cartridge 25 is mounted in the drum sub-unit 26, and the handle 210 is made to fall over in a fallen over state.

A memory chip 223 as an example of a memory element is attached to the front wall 203 as shown in FIG. 3. One ends of two wirings 224 are connected to the memory chip 223. The respective wirings 224 extend toward the handle supporting portions 211, and as shown in FIG. 5, the other ends thereof are connected to the ring-shaped members 216. Further, at the respective sides, the spacing protrusions 209 and the ring-shaped members 216 are electrically connected to one another via wirings 225 as shown in FIG. 4. Moreover, at the respective sides, the pressing protrusions 222 and the supporting shafts 215 are electrically connected to one another via wirings 226.

In accordance therewith, the memory chip 223 and the respective spacing protrusions 209 are electrically connected to one another via the wirings 224, the ring-shaped members 216, and the wirings 225, and the respective spacing protrusions 209 serve as terminals for reading/writing information with respect to the memory chip 223. Further, the memory chip 223 and the respective pressing protrusions 222 are electrically connected to one another via the wirings 224, the ring-shaped members 216, the supporting shafts 215, and the wirings 226, and the respective pressing protrusions 222 as well serve as terminals for reading/writing information with respect to the memory chip 223.

As information written into the memory chip 223, a number of operations of image formation (a number of sheets to be printed) executed by use of the developer cartridge 25, an ID code unique to the developer cartridge 25, and the like can be exemplified.

In the present embodiment, the spacing protrusions 209, the supporting shafts 215, and the pressing protrusions 222 are formed of polyacetal or the like.

(2) Mounting and Removal of Developer Cartridge with Respect to Drum Unit

With respect to the developer cartridge 25 corresponding to each color, the handle 210 is gripped by inserting fingers into the grip hole 221 of the handle 210, and as shown in FIG. 2, the developer cartridge 25 is mounted to the drum sub-unit 26 corresponding to the developer cartridge 25 from above the drum unit 24.

In greater detail, the collar members 208 at the both ends in an axial direction of the developing roller 33 of the developer cartridge 25 are inserted into the guide slots 106 of the respective side frames 104 of the corresponding drum sub-unit 26, and the developer cartridge 25 is pushed downward along the guide slots 106 into the drum sub-unit 26. When the developing roller 33 contacts the photosensitive drum 27, it is restricted from pushing the developer cartridge 25 thereto. Then, the developer cartridge 25 is made to fall over in a direction in which the upper end thereof leans against the center frame 105 at the front side centering on the shaft of the developing roller 33 due to its own weight of the developer cartridge 25, and the front wall 203 of the case 30 contacts the center frame 105 to be supported. In accordance therewith, the developer cartridge 25 is positioned with respect to the drum sub-unit 26, and the mounting of the developer cartridge 25 into the drum sub-unit 26 is achieved.

In this way, after the developer cartridge 25 is mounted, when the handle 210 in a standing state is released from a hand, the handle 210 is made to fall over from a standing state to a fallen over state with the supporting shafts 215 as fulcrums due to its own weight.

On the other hand, provided that, in a state in which the developer cartridge 25 is mounted into the drum unit 24 (drum sub-unit 26), the handle 210 is gripped, and the handle 210 is pulled up to a standing state from a fallen over state, and is lifted up, it is possible to remove the developer cartridge 25 from the drum unit 24.

4. Rail and Spacing and Pressing Mechanism

Figure 6:
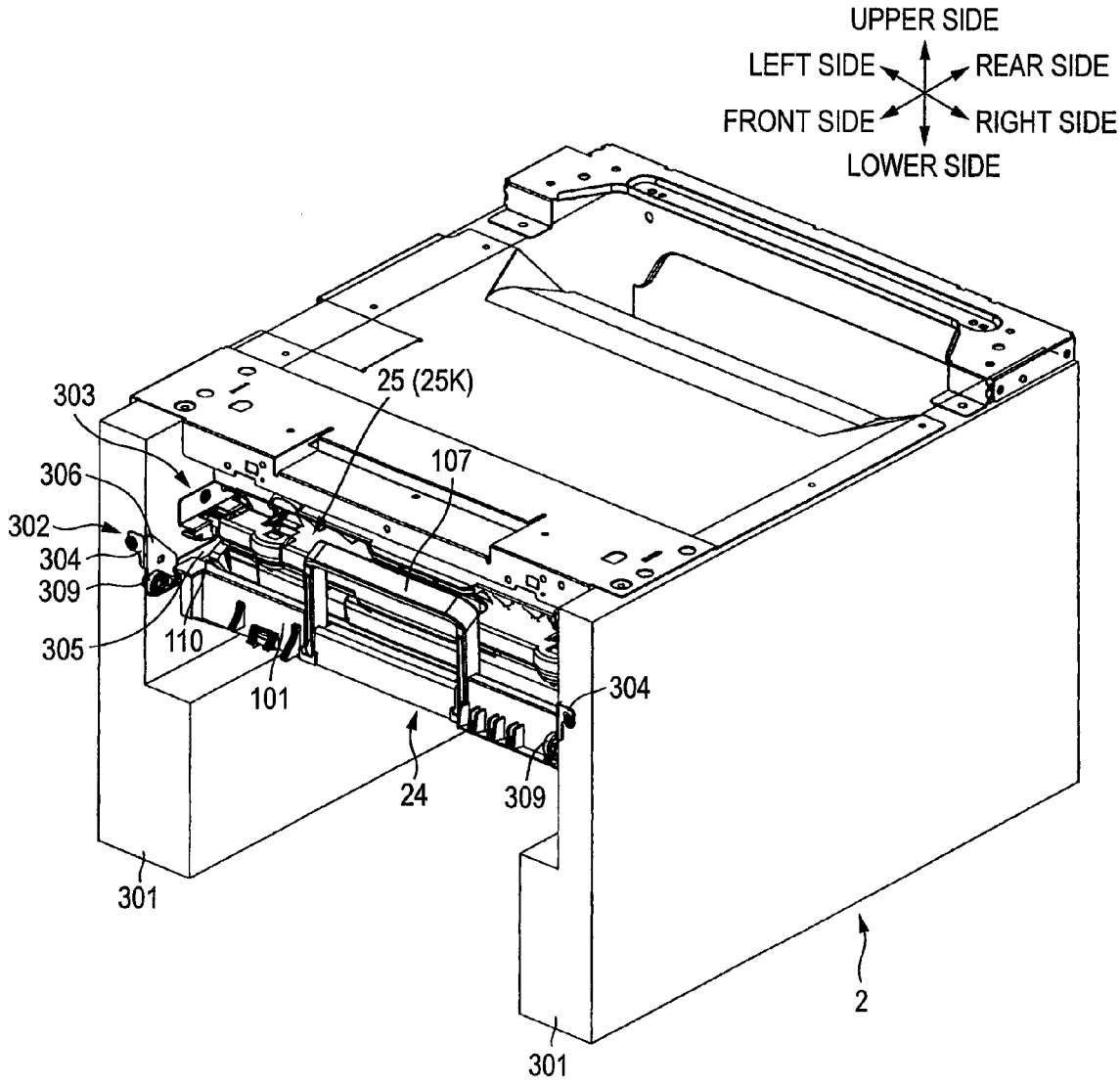
FIG. 6 is a perspective view of a body casing and the drum unit shown in FIG. 1, which are viewed from above the right front thereof.

FIG. 6 is a perspective view of the body casing 2 and the drum unit 24 which are viewed from above the right front thereof. FIG. 6 shows a state in which the outer covering plate and the front cover 9 of the body casing 2 are detached, and the drum unit 24 is mounted into the body casing 2.

The body casing 2 includes a pair of body frames 301 disposed to face one another in a longitudinal direction with the drum unit 24 therebetween. In the inner surfaces of the respective body frames 301, there are provided: rails 302 to guide the mounting and removal of the drum unit 24; and spacing and pressing mechanisms 303 to space and press the developing rollers 33 of the developer cartridge 25 mounted into the drum unit 24, with respect to the photosensitive drum 27.

Figure 7:
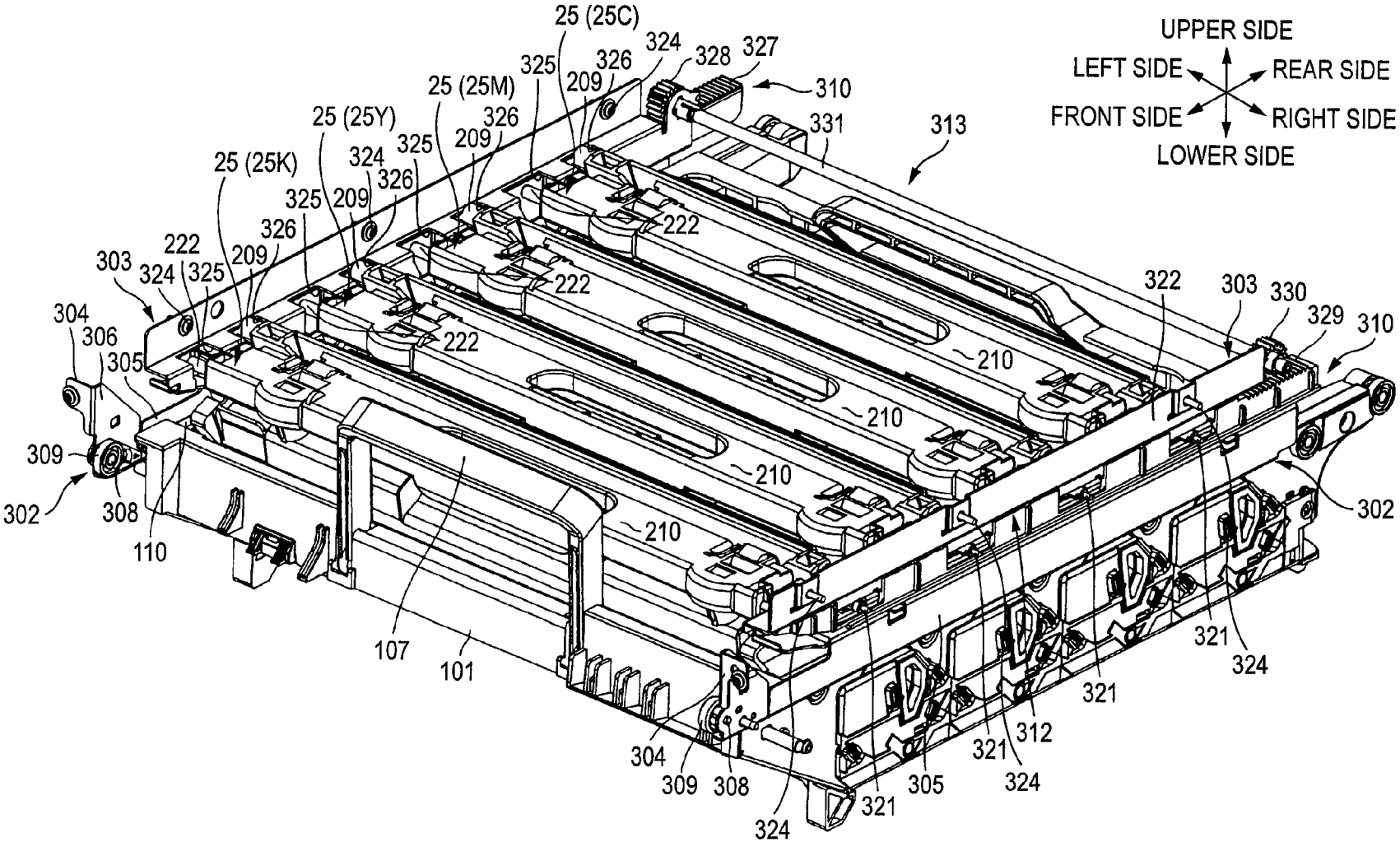
FIG. 7 is a perspective view of the drum unit, right and left rails and spacing and pressing mechanisms shown in FIG. 6, which are viewed from above the right front thereof.
Figure 8:
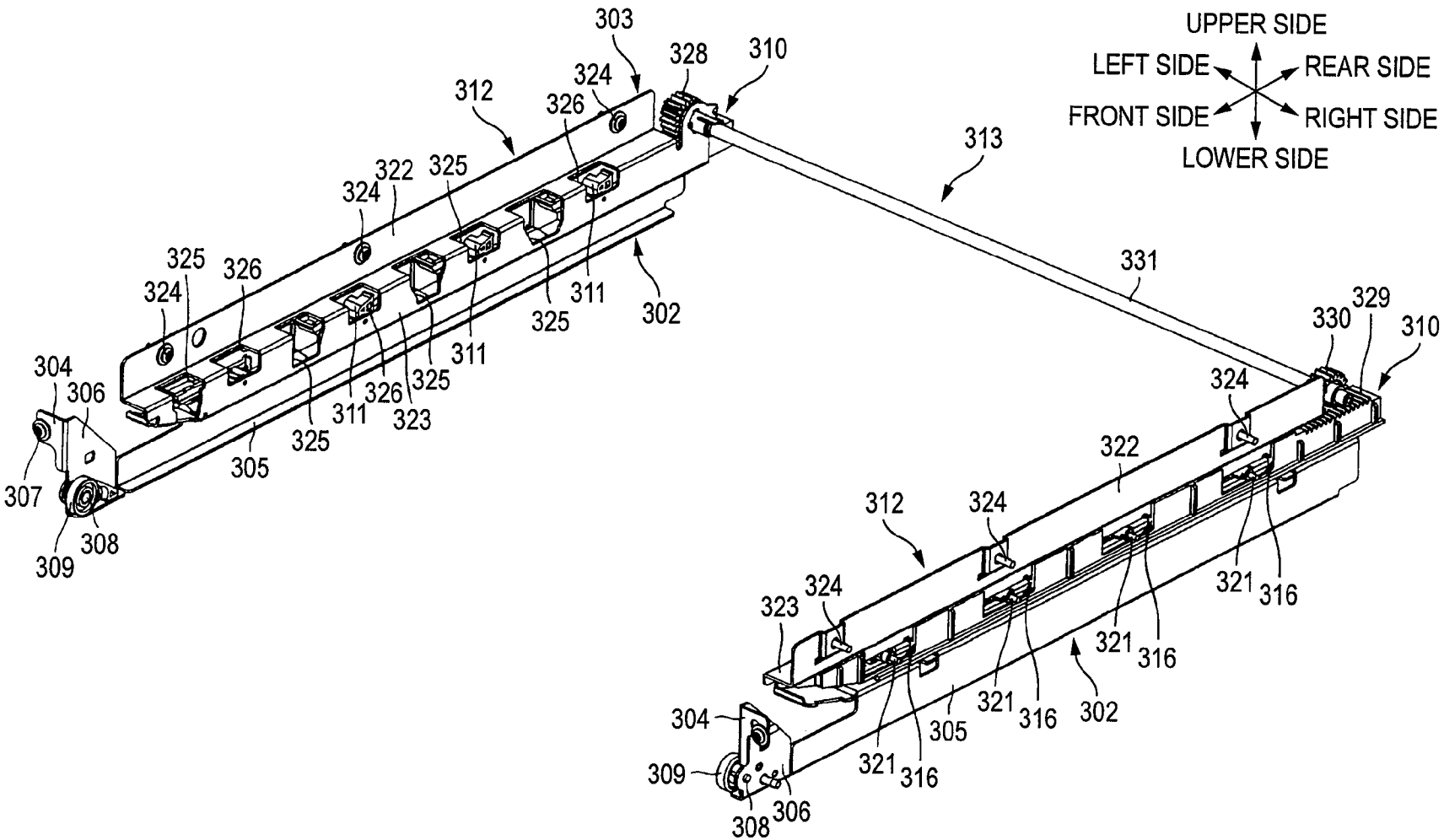
FIG. 8 is a perspective view of the rails and the spacing and pressing mechanisms shown in FIG. 7, which are viewed from above the right front thereof.

FIG. 7 is a perspective view of the drum unit 24, the right and left rails 302, and the spacing and pressing mechanisms 303, which are viewed from above the right front thereof. Further, FIG. 8 is a perspective view of the right and left rails 302 and the spacing and pressing mechanisms 303 which are viewed from above the right front thereof.

(1) Rails

The right and left rails 302 are disposed to face one another in a longitudinal direction with the drum unit 24 therebetween. The respective rails 302 integrally have rail fixing parts 304 disposed to face one another at the front end faces of the body frames 301, rail main body parts 305 extending in an anteroposterior direction (horizontal direction) along the inner surfaces of the body frames 301, and joining parts 306 which join the rail fixing parts 304 and the rail main body parts 305.

The rail fixing parts 304 are fixed to the front end faces of the body frames 301 with screws 307.

The rail main body parts 305 are formed into substantially L-shapes on cross sections whose lower ends are bent to the inner sides (the right side in a case of the left rail main body part 305, and the left side in a case of the right rail main body part 305), and the flange portions 110 of the respective side plates 103 of the drum unit 24 are placed on the portions thereof extending horizontally in a state in which the drum unit 24 is mounted into the body casing 2.

Roller supporting shafts 308 are supported so as to run through the joining parts 306 in a longitudinal direction. Rail rollers 309 supported rotatably by the roller supporting shafts 308 are disposed on the planes of the respective joining parts 306 facing one another. The uppermost end portions of the circumferential surfaces of the rail rollers 309 are located above the lower end portions (portions extending horizontally) of the rail main body parts 305.

(2) Mounting of Drum Unit into Body Casing

In order to mount the drum unit 24 into the body casing 2, first, the drum unit 24 is lifted up by gripping respectively the near side gripper 107 and the back side gripper 109 (see FIG. 2) of the drum unit 24 with both hands. Then, referring to FIG. 1, the opening 8 is opened by making the front cover 9 fall over, and the drum unit 24 is made to go into the drum housing space 7 from the opening 8.

At this time, the respective roller members 111 provided to the rear ends of the drum unit 24 are moved to roll on the rail main body parts 305 of the rails 302. Further, the back gripper 109 is released from a hand, the both flange portions 110 of the drum unit 24 are respectively placed on the right and left rail rollers 309. When the drum unit 24 is pushed backward in this state, the respective roller members 111 move to roll on the rail main body parts 305, and the flange portions 110 slide on the respective rail rollers 309, which makes the drum unit 24 move smoothly. Further, the spacing protrusions 209 and the pressing protrusions 222 of the respective developer cartridges 25 slide on a cum housing portion 323 of a holder fixing portion 322 described later.

Then, when the respective roller members 111 drop out of the rails 302 to the back side, and the flange portions 110 drop out of the respective rail rollers 309 to the back side of the respective rail rollers 309, and the respective flange portions 110 are placed on the portions of the rail main body parts 305 extending horizontally, the pressing protrusions 222 and the spacing protrusions 209 of the respective developer cartridges 25 are respectively received in pressing protrusion receiving parts 325 and spacing protrusion receiving parts 326 described later, which completes the mounting of the drum unit 24 into the body casing 2.

Thereafter, the front cover 9 is closed by releasing the hand from the near side gripper 107, and the opening 8 is closed with the front cover 9. When the front cover 9 is closed, the near side gripper 107 turns from a standing state to the housed position with the supporting shafts 108 as fulcrums so as to interlock thereto.

(3) Spacing and Pressing Mechanism

As shown in FIG. 8, the spacing and pressing mechanism 303 includes a pair of translation cam members 310, cam holders 312 to hold the respective translation cam members 310 so as to rectilinearly move those in an anteroposterior direction, and a synchronous movement mechanism 313 to rectilinearly move the pair of translation cam members 310 so as to synchronize those.

Figure 9:
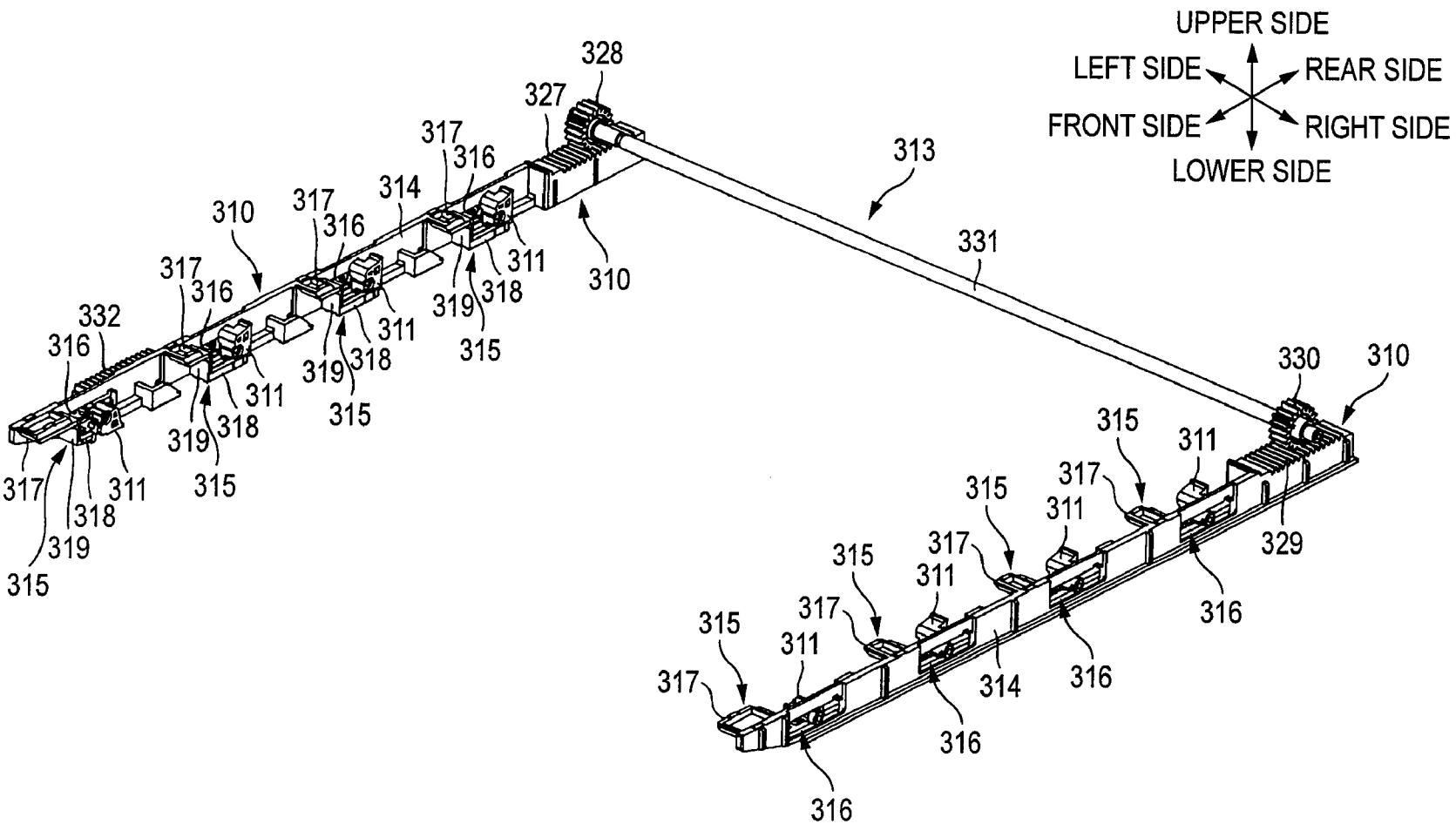
FIG. 9 is a perspective view of translation cam members, intermediate members, and a synchronous movement mechanism shown in FIG. 8, which are viewed from above the right front thereof.
Figures 10A, 10B, 10C, 10D, 10E:
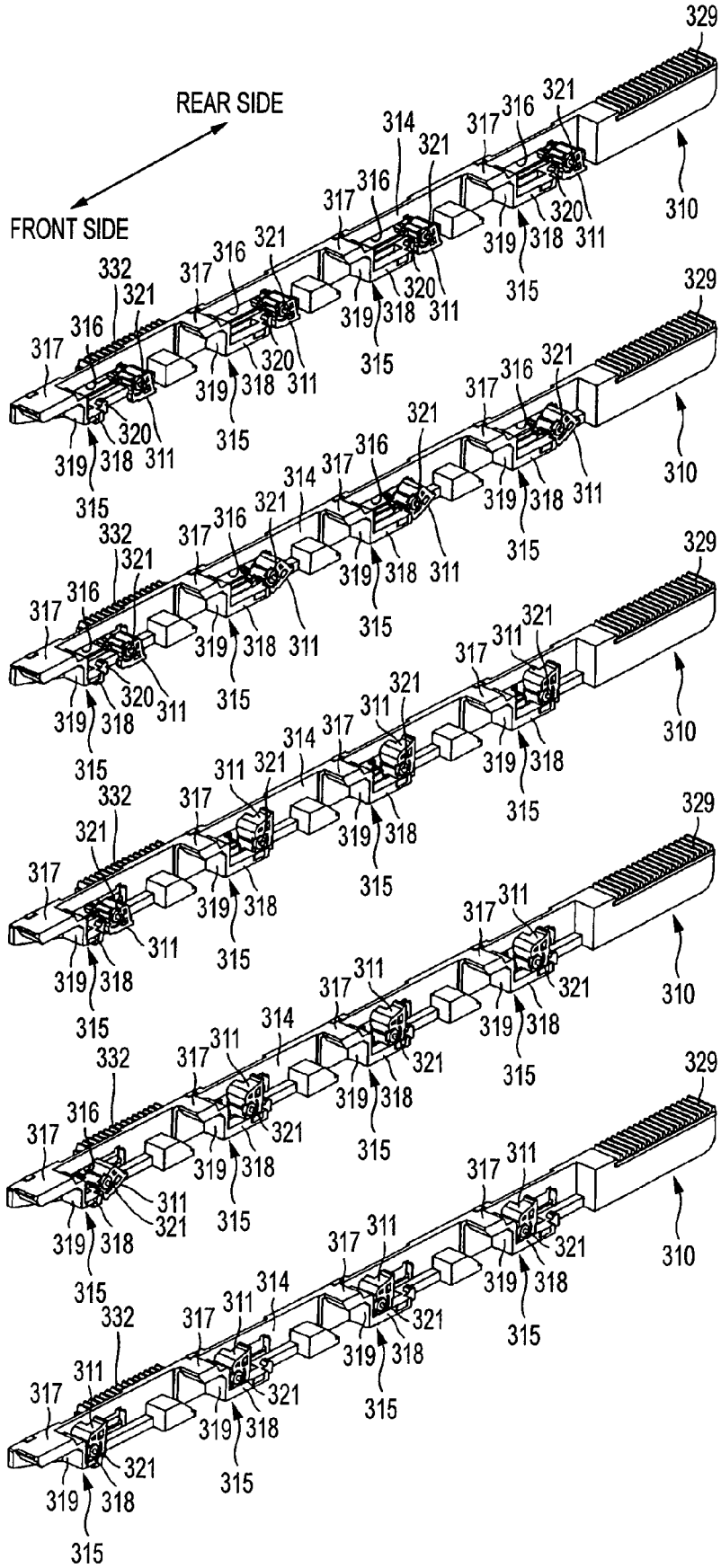
FIGS. 10A to 10E are perspective views for explanation of actions of the translation cam member and the intermediate members shown in FIG. 9.
Figure 11:
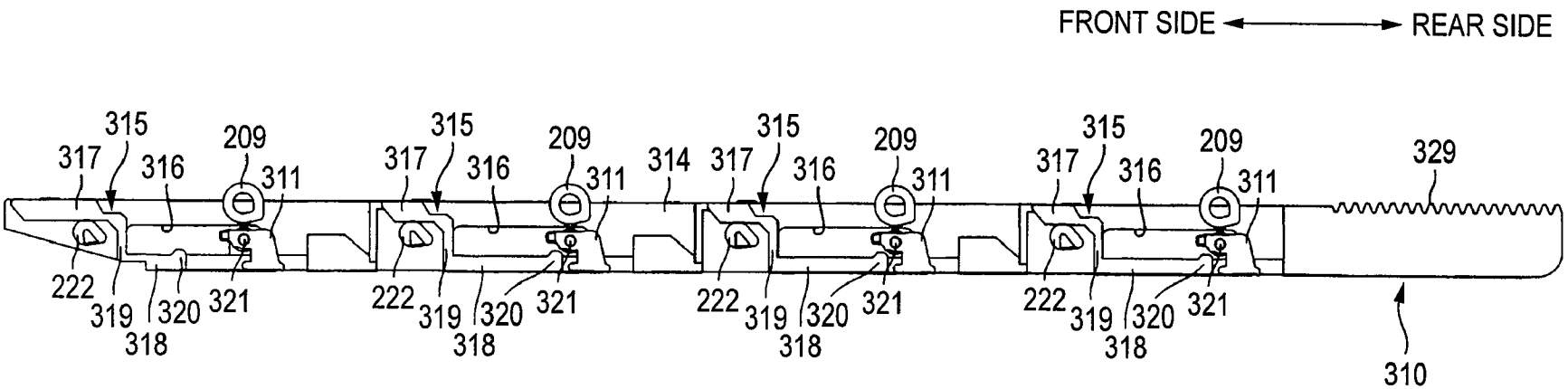
FIG. 11 is a right side view of the translation cam member and the intermediate members in a state of FIG. 10A.
Figure 12:
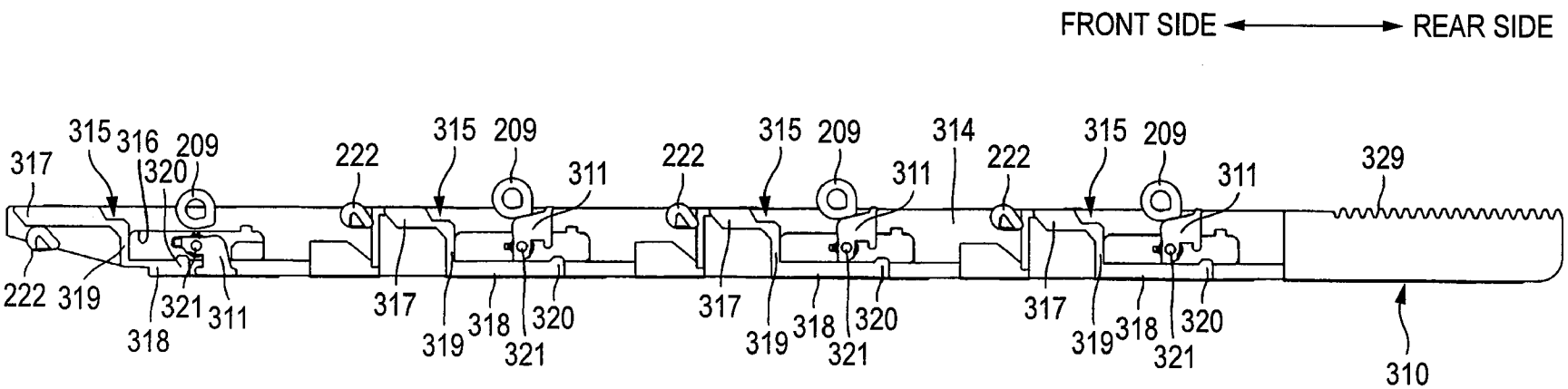
FIG. 12 is a right side view of the translation cam member and the intermediate members in a state of FIG. 10C.
Figure 13:
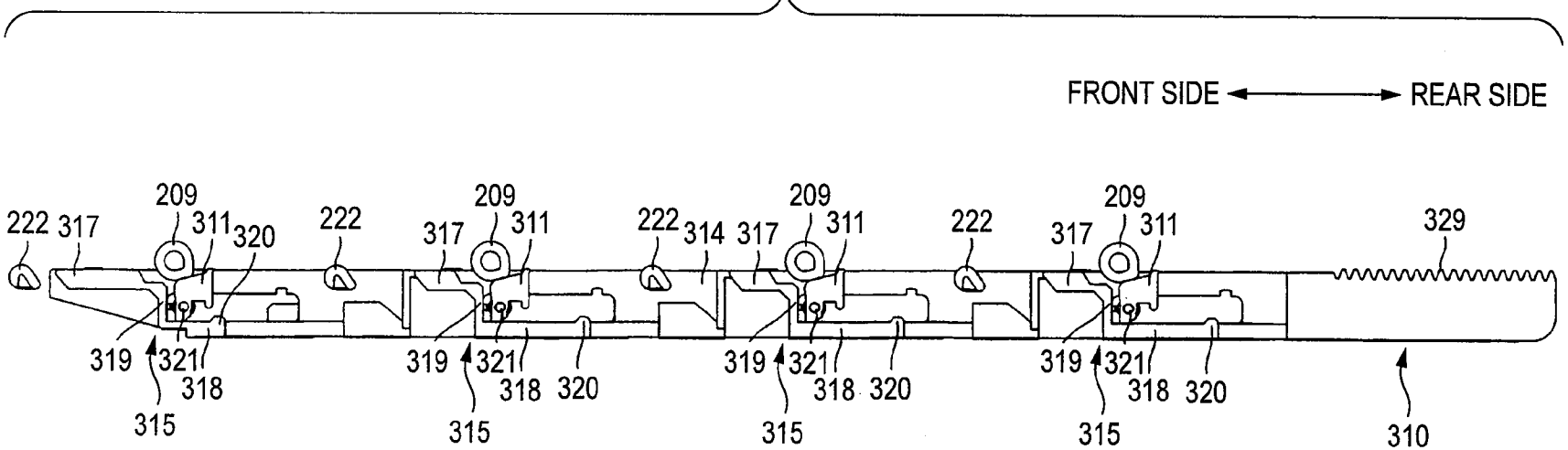
FIG. 13 is a right side view of the translation cam member and the intermediate members in a state of FIG. 10E.

FIG. 9 is a perspective view of the translation cam members 310 and the synchronous movement mechanism 313 which are viewed from above the right front thereof. That is, in FIG. 9, a perspective view in which illustrations of the cam holders 312 are omitted, and the spacing and pressing mechanism 303 is viewed from above the right front thereof, is shown. Further, FIGS. 10A to 10E are perspective views for explanation of actions of the translation cam members 310. Moreover, FIG. 11 is a right side view of the translation cam member 310 in a state of FIG. 1A, FIG. 12 is aright side view of the translation cam member 310 in a state of FIG. 10C, and FIG. 13 is a right side view of the translation cam member 310 in a state of FIG. 10E.

With respect to the translation cam member 310, respective members (described hereinafter) are formed of conductive materials. The translation cam member 310 includes a laminar cam body plate 314 extending in an anteroposterior direction along the inner surface of the body frame 301 (see FIG. 6), four operational members 315 provided to the inner surface of the cam body plate 314 (planes facing one another of the cam body plates 314 of the respective translation cam member 310), and intermediate members 311 disposed behind the respective operational members 315.

Four rectangular holes 316 in substantially rectangular shapes which are long in an anteroposterior direction are formed at regular intervals in an anteroposterior direction at the cam body plate 314.

The four operational members 315 are disposed at the respective front sides of the four rectangular holes 316. The respective operational members 315 integrally include pressing force application portions 317 which are formed in shapes whose side views are crank shapes, and extend along the upper edge of the cam body plate 314, and which are to press the pressing protrusions 222 of the developer cartridges 25 downward, contacting/spacing force application portions 318 which extend along the bottom edge of the cam body plate 314, and which are to make the intermediate members 311 turn as will be described later, and joining parts 319 which join the rear ends of the pressing force application portions 317 and the front ends of the contacting/spacing force application portions 318.

As shown in FIG. 11 to FIG. 13, projected protruding portions 320 projecting upward are formed at the rear ends of the contacting/spacing force application portions 318.

Further, the most anterior operational member 315 has a shape different from those of the other three operational members 315 (hereinafter called "the three posterior operational members 315"). That is, the pressing force application portion 317 of the most anterior operational member 315 is formed longer in its length in an anteroposterior direction as compared with those of the pressing force application portions 317 of the three posterior operational members 315. Further, the contacting/spacing force application portion 318 of the most anterior operational member 315 is formed shorter in its length in an anteroposterior direction as compared with those of the contacting/spacing force application portions 318 of the three posterior operational members 315. Due to such differences in shapes (sizes), as will be described later, it is possible to make the developing rollers 33 of all the developer cartridges 25 press the photosensitive drums 27, to make only the developing roller 33 of the black developer cartridge 25K press the photosensitive drum 27, or to make the developing rollers 33 of all the developer cartridges 25 be spaced from the photosensitive drums 27.

The respective intermediate members 311 face the respective rectangular holes 316 in a longitudinal direction. As shown in FIG. 11 to FIG. 13, the respective intermediate members 311 are formed in shapes whose side views are substantially L-shapes, and are formed in block shapes having thicknesses in a longitudinal direction. Intermediate member supporting shafts 321 run through one ends of the respective intermediate members 311 in a longitudinal direction, and the intermediate members 311 are supported rotatably by the intermediate member supporting shafts 321. In a state in which the respective intermediate members 311 are not contacted with the contacting/spacing force application portions 318 (see FIG. 11), the lower ends thereof face the protruding portions 320 of the contacting/spacing force application portions 318 with a distance in an anteroposterior direction.

As shown in FIG. 7, the intermediate member supporting shafts 321 are disposed at regular intervals (intervals equal to intervals among the respective spacing protrusions 209 in a state in which the four developer cartridges 25 are mounted into the drum unit 24) to each other in an anteroposterior direction. The respective intermediate member supporting shafts 321 extend in the longitudinal direction of the cam body plates 314 due to the intermediate members 311 supported thereby being inserted into the rectangular holes 316 which the intermediate members face, and one ends thereof are supported to be unable to rotate on the cam holder 312.

As shown in FIG. 8, the cam holder 312 integrally has the laminar holder fixing part 322 extending in an anteroposterior direction along the inner surface of the body frame 301, and a cam housing portion 323 continuing at the bottom edge of the holder fixing part 322.

The holder fixing part 322 is fixed to the inner surface of the body frame 301 with screws 324. The cam housing portion 323 is formed in a substantially sideways-square U-shape on cross section which extends from the entire length of the bottom edge of the holder fixing part 322 to a direction of being separated away from the inner surface of the body frame 301, and is bent downward, and is further bent to a direction of approaching the inner surface of the body frame 301. In the cam housing portion 323, the pressing protrusion receiving parts 325 capable of receiving the pressing protrusions 222 of the developer cartridge 25 and the spacing protrusion receiving parts 326 capable of receiving the spacing protrusions 209 of the developer cartridge 25 are alternately formed four each thereof by sequentially notching the cam housing portion 323 from the upper surface to the side surface. That is, in the cam housing portion 323, the four pressing protrusion receiving parts 325 are formed in an anteroposterior direction at regular intervals which are the same as the intervals among the respective pressing protrusions 222 in a state in which the respective developer cartridges 25 are mounted into the drum unit 24. Further, the four spacing protrusion receiving parts 326 are formed in an anteroposterior direction at regular intervals which are the same as the intervals among the respective spacing protrusions 209 in a state in which the respective developer cartridges 25 are mounted into the drum unit 24. The respective spacing protrusion receiving parts 326 are disposed behind the respective pressing protrusion receiving parts 325. In a state in which the spacing protrusions 209 are received in the respective spacing protrusion receiving parts 326, the respective spacing protrusions 209 face the respective intermediate members 311 from above.

The synchronous movement mechanism 313 is configured to transmit driving force for rectilinear travel to the right translation cam member 310 from the left translation cam member 310 in accordance with a rectilinear travel of the left translation cam member 310.

That is, as shown in FIG. 9, the synchronous movement mechanism 313 includes a left rack gear 327 formed on the upper surface of the rear end of the left translation cam member 310, a left pinion gear 328 engaged with the left rack gear 327, a right rack gear 329 formed on the upper surface of the rear end of the right translation cam member 310, a right pinion gear 330 engaged with the right rack gear 329, and a connecting shaft 331 to which the left pinion gear 328 and the right pinion gear 330 are attached to be unable to rotate relatively.

Further, an input rack gear 332 to which driving force of a motor (not shown) is inputted is provided on the outer surface of the cam body plate 314 in the left translation cam member 310. In the present embodiment, the translation cam members 310 are formed of polyacetal or the like.

(4) Spacing and Pressing Operations

The operations of the spacing and pressing mechanism 303 will be described with mainly reference to FIG. 10 to FIG. 13.

As shown in FIG. 10A and FIG. 11, in a state in which the translation cam member 310 is moved to the most anterior position, the contacting/spacing force application portions 318 of the respective operational members 315 and the intermediate members 311 disposed respectively behind those face one another in a noncontact state at intervals in an antero-posterior direction. Intervals greater than the intervals between the contacting/spacing force application portions 318 and the intermediate members 311 disposed respectively behind those of the three posterior operational members 315 are formed between the contacting/spacing force application portions 318 and the intermediate member 311 disposed behind it of the most anterior operational member 315.

In this state, the respective developer cartridges 25 are disposed at contacting positions at which the developing rollers 33 and the photosensitive drums 27 contact each other. Then, the pressing force application portions 317 of the respective operational members 315 contact the pressing protrusions 222 of the respective developer cartridges 25 from above to press the respective pressing protrusions 222 downward. Due to the respective pressing protrusions 222 being pressed downward, in the respective developer cartridges 25, the handles 210 are turned with the supporting shafts 215 as fulcrums into a pressed state, and the elastically contacting members 219 are pressed down by the handles 210 (concave portions 220). Pressing force inputted to the respective pressing protrusions 222 from the pressing force application portions 317 are adjusted to be appropriate force due to the elasticity of the elastically contacting members 219 to bias the cases 30 downward. In accordance therewith, the developing rollers 33 are pressed onto the photosensitive drums 27.

From this state, when driving force of the motor (not shown) is inputted to the input rack gear 332, and the left translation cam member 310 is moved backward, the left pinion gear 328 rotates in accordance with the movement of the left translation cam member 310, and the rotation of the left pinion gear 328 is transmitted to the right pinion gear 330 via the connecting shaft 331. Then, the right pinion gear 330 rotates in the same direction of the left pinion gear 328, which makes the right translation cam member 310 move backward.

As the backward movement of the translation cam member 310 progresses, the engagement among the pressing force application portions 317 of the three posterior operational members 315 and the pressing protrusions 222 of the developer cartridges 25 is cancelled, and the pressing onto the pressing protrusions 222 by the pressing force application portions 317 is cancelled. Further, as shown in FIG. 10B, the contacting/spacing force application portions 318 of the three posterior operational members 315 contact the lower ends of the intermediate members 311 disposed respectively behind those to press the lower ends of the respective intermediate members 311 backward, and the respective intermediate members 311 turn to be lifted upward with the intermediate member supporting shafts 321 as fulcrums. In the process of the turning of the respective intermediate members 311, the respective intermediate members 311 contact the spacing protrusions 209 positioned respectively thereabove from beneath, and upward spacing forces are applied to the spacing protrusions 209 from the respective intermediate members 311. In accordance therewith, the yellow developer cartridge 25Y, the magenta developer cartridge 25M, and the cyan developer cartridge 25C are lifted up upward.

Then, as the backward movement of the translation cam member 310 further progresses, and when one ends (ends at the sides through which the intermediate member supporting shafts 321 are inserted) of the intermediate members 311 contact the upper surfaces of the contacting/spacing force application portions 318 of the three posterior operational members 315 as shown in FIG. 10C and FIG. 12, the yellow developer cartridge 25Y, the magenta developer cartridge 25M, and the cyan developer cartridge 25C are disposed at spaced positions, and the developing rollers 33 of the yellow developer cartridge 25Y, the magenta developer cartridge 25M, and the cyan developer cartridge 25C are spaced from the photosensitive drums 27. At this time, the pressing protrusions 222 of the black developer cartridge 25K are pressed by the pressing force application portions 317 of the operational members 315. In accordance therewith, only the developing roller 33 of the black developer cartridge 25K is made into a state of being pressed onto the photosensitive drum 27.

Thereafter, as the backward movement of the translation cam member 310 further progresses, the engagement between the pressing force application portions 317 of the most anterior operational member 315 and the pressing protrusions 222 of the black developer cartridge 25K is cancelled, and the pressing onto the pressing protrusions 222 by the pressing force application portions 317 is cancelled. Further, as shown in FIG. 10D, the contacting/spacing force application portion 318 of the most anterior operational member 315 contacts the lower end of the intermediate member 311 disposed behind it to press the lower end of the intermediate member 311 backward, and the intermediate member 311 turns to be lifted upward with the intermediate member supporting shaft 321 as a fulcrum. In the process of the turning of the intermediate member 311, the intermediate member 311 contacts the spacing protrusions 209 of the black developer cartridge 25K positioned thereabove from beneath, and upward spacing force is applied to the spacing protrusions 209 from the intermediate member 311. Therefore, the black developer cartridge 25K is lifted upward.

Then, as the backward movement of the translation cam member 310 further progresses, and when one end (an end at the side through which the intermediate member supporting shaft 321 is inserted) of the intermediate member 311 contacts the upper surface of the contacting/spacing force application portion 318 of the most anterior operational member 315 as shown in FIG. 10E and FIG. 13, the black developer cartridge 25K is moved to a spaced position, and the developing roller 33 of the black developer cartridge 25K is spaced from the photosensitive drum 27. In accordance therewith, the developing rollers 33 of all the developer cartridges 25 are spaced from the photosensitive drums 27.

In addition, provided that the translation cam member 310 is moved forward from the state shown in FIG. 10E, it is possible to return to the respective states shown in FIGS. 10A to 10D. At this time, the protruding portions 320 of the respective contacting/spacing force application portions 318 are latched onto the intermediate members 311 to make the intermediate members 311 turn to a direction of being spaced from the spacing protrusions 209 (downward).

5. Effects

Both of the pressing protrusions 222 to which pressing force to make the developing roller 33 contact the photosensitive drum 27 in a pressed state is inputted and the spacing protrusions 209 to which spacing force to make the developing roller 33 be spaced from the photosensitive drum 27 is inputted function as terminals electrically connected to the memory chip 223 disposed in the case 30 of the developer cartridge 25. When pressing force is inputted to the pressing protrusions 222 (at the time of inputting pressing force), the pressing force application portions 317 to input pressing force contact the pressing protrusions 222. Further, when spacing force is inputted to the spacing protrusions 209 (at the time of inputting spacing force), the intermediate members 311 to input spacing force contact the spacing protrusions 209. Then, because the pressing force application portions 317 and the intermediate members 311 are formed of conductive materials, provided that the pressing force application portions 317 and the intermediate members 311, and a read-writer (not shown) to read and write information with respect to the memory chip 223 are electrically connected to one another, at the time of inputting pressing force and the time of inputting spacing force, it is possible to reliably achieve an electrical connection between the read-writer and the memory chip 223. As a result, even with a structure in which the developer cartridges 25 are provided to be movable, it is possible to satisfactorily carry out read/write information with respect to the memory chips 223 disposed in the developer cartridges 25.

Further, because the handle 210 is provided to the case 30, it is possible to move the developer cartridges 25 (to carry the developer cartridges 25, and to mount and remove the developer cartridges 25 with respect to the body casing 2) by gripping the handle 210. Further, because the hand of an operator does not contact the memory chip 223 disposed in the case by gripping the handle 210 at the time of moving the developer cartridges 25, it is possible to prevent stains by contacting the memory chip 223 with the hand. Moreover, because the pressing protrusions 222 are formed to the handle 210, and the elastically contacting members 219 are provided between the handle 210 and the case 30, it is possible to adjust pressing force to be inputted to the pressing protrusions 222 due to the elasticity of the elastically contacting members 219. As a result, it is possible to make the developing roller 33 contact the photosensitive drum 27 in an appropriate pressed state.

Further, the pressing protrusions 222 formed to the handle 210 function as terminals as well. The handle 210 includes the supporting shafts 215 formed of conductive materials, and the supporting shafts 215 are electrically connected to the pressing protrusions 222. On the other hand, the ring-shaped members 216 formed of conductive materials are provided to the through holes 212 of the handle supporting portions 211 through which the supporting shafts 215 are inserted. The ring-shaped members 216 are electrically connected to the memory chip 223. Then, the plurality of protrusions 217 are formed on the circumferential surfaces of the supporting shafts 215, and those protrusions 217 contact the ring-shaped members 216 externally fitted to the supporting shafts 215. In accordance therewith, even when the handle 210 is swung with the supporting shafts 215 as fulcrums, it is possible to secure the contact between the supporting shafts 215 and the ring-shaped members 216, and it is possible to secure an electrical connection between the memory chip 223 and the pressing protrusions 222 functioning as terminals as well.

6. Another Embodiment

Figure 14:
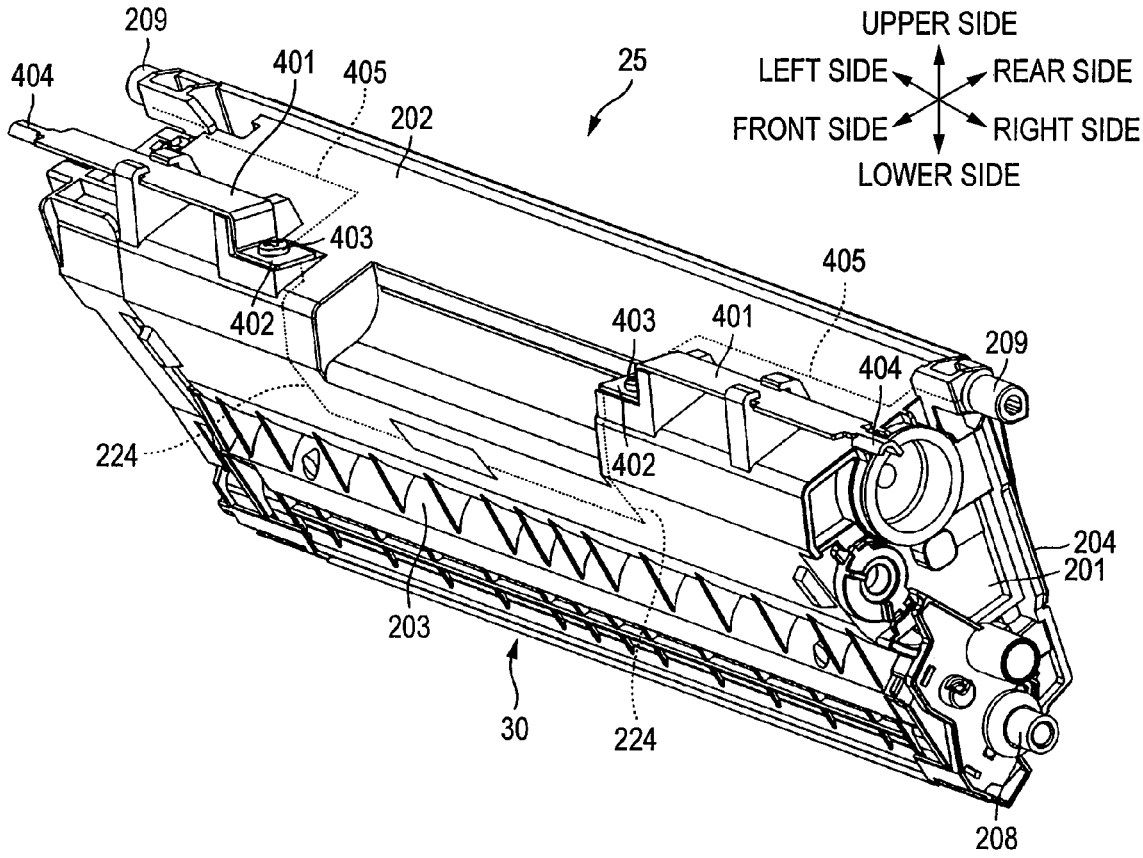
FIG. 14 is a perspective view showing another embodiment of the developer cartridge (an embodiment having plate spring-shaped members).

FIG. 14 is a perspective view showing another embodiment of the developer cartridge 25. In FIG. 14, portions corresponding to the respective parts described above are denoted by the same reference numerals of the respective parts. Further, in the following descriptions, detailed descriptions of the respective parts denoted by the same reference numerals will be omitted.

In this developer cartridge 25, the handle 210 is not provided, and plate spring-shaped members 401 are provided to the both ends of the upper wall 202 of the case 30.

The respective plate spring-shaped members 401 are fixed to the upper surface of the upper wall 202 at one ends 402 thereof with screws 403. The left plate spring-shaped member 401 is bent upward from the one end 402, and is further bent to extend to the left. The right plate spring-shaped member 401 is bent upward from the one end 402, and is further bent to extend to the right. Then, the other ends 404 of the respective plate spring-shaped members 401 extend outward from the side walls 201 of the case 30 so as to form pressing protrusions to which pressing forces from the pressing force application portions 317 of the spacing and pressing mechanism 303 are inputted.

In such a structure, the pressing force application portions 317 of the spacing and pressing mechanism 303 contact the other ends 404 of the respective plate spring-shaped members 401 from above to press the other ends 404 downward. Pressing forces inputted to the other ends 404 from the pressing force application portions 317 are adjusted to be appropriate forces due to the elastic deformation of the plate spring-shaped members 401 to bias the case 30 downward. In accordance therewith, the developing roller 33 is pressed onto the photosensitive drum 27.

The two wirings 224 extending from the memory chip 223 are respectively connected to the one ends 402 of the right and left respective plate spring-shaped members 401. Further, at the right and left respective sides, the spacing protrusions 209 are electrically connected to the one ends 402 of the plate spring-shaped members 401 via wirings 405.

In accordance with this structure as well, effects which are the same as those of the developer cartridge 25 shown in FIG. 3 and FIG. 4 can be performed.

7. Modified Example

The present invention is not limited to the tandem type color laser printer 1, and may be applied to an intermediate transfer type color laser printer, or may be applied to a monochrome laser printer.

Further, in the above-described embodiment, the example that the respective members of the translation cam member 310 are formed of conductive materials has been shown. However, it is not limited thereto. That is, in the translation cam member 310, conductive sheet metals are disposed to only the contact portions between the pressing protrusions 222 and the spacing protrusions 209, and the sheet metals and a controller at the body side may be wired.

What is claimed is:

1. An image forming apparatus comprising:

an image carrier;

a developing device configured to hold a developer carrier to supply developer to the image carrier, the developing device movable to a contacting position where the developer carrier contacts the image carrier and to a spaced position where the developer carrier is spaced from the image carrier; and a memory element disposed in the developing device, wherein the developing device comprises: a pressing force input portion configured to receive pressing force to make the developer carrier contact the image carrier; and a spacing force input portion configured to receive spacing force to make the developing device move from the contacting position to the spaced position, and wherein at least one of the pressing force input portion and the spacing force input portion comprises a terminal electrically connected to the memory element, and wherein the terminals are provided to both of the pressing force input portion and the spacing force input portion.

2. The image forming apparatus according to claim 1, wherein the developing device comprises:

a case that holds the developer carrier at one end portion; and a grip member swingably provided at another end portion opposite to the one end portion of the case;

wherein the memory element is disposed in the case, and wherein the pressing force input portion is formed on the grip member.

3. The image forming apparatus according to claim 2, wherein the case comprises a first connecting portion to which the grip member is swingably attached, the first connecting portion formed of a conductive material and electrically connected to the memory element, and wherein the grip member comprises a second connecting portion attached to the first connecting portion of the case, the second connecting portion formed of a conductive material and electrically connected to the terminal.

4. The image forming apparatus according to claim 3, wherein the pressing force input portion comprises the terminal, wherein the second connecting portion comprises a shaft formed of a conductive material and electrically connected to the terminal, and wherein the first connecting portion comprises:

a shaft insertion portion configured to allow the shaft to be inserted; and a ring-shaped member formed of a conductive material and provided in the shaft insertion portion so that the shaft is fitted to and rotatably supported by the ring-shaped member, the ring-shaped member electrically connected to the memory element.

5. The image forming apparatus according to claim 4, wherein the second connecting portion comprises an elastic member having a fixed portion fixed to the grip member and a free portion unfixed to the grip member, and wherein the shaft extends from the free portion of the elastic member.

6. The image forming apparatus according to claim 4, wherein the shaft comprises one or more protrusions integrally formed on an outer surface of the shaft, wherein the shaft is fitted to the ring-shaped member in a state where the protrusions contact an inner surface of the ring-shaped member.

7. The image forming apparatus according to claim 6, wherein the inner surface of the ring-shaped member is formed of a conductive shrinkable material.

8. The image forming apparatus according to claim 1, further comprising a translation cam member formed of a conductive material and configured to rectilinearly travel to a pressing force input position and a spacing input position, wherein the translation cam member at the pressing force input position contacts the pressing force input portion to input the pressing force to the pressing force input portion, and wherein the translation cam member at a spacing input position contacts the spacing force input portion to input spacing force to the spacing force input portion.

9. The image forming apparatus according to claim 8, comprising a plurality of the image carriers, wherein a plurality of the developing devices corresponding to the plurality of the image carriers are mountable to the image forming apparatus, wherein the translation cam member applies the pressing force and the spacing force selectively to the plurality of the developing devices.

10. A developer cartridge removably mountable to an image forming apparatus having an image carrier, the developer cartridge comprising:

a developer carrier configured to supply developer to the image carrier;

a case that holds the developer carrier;

a memory element disposed in the case;

a pressing force input portion configured to receive pressing force to make the developer carrier contact the image carrier; and a spacing force input portion configured to receive spacing force to make the developer carrier be spaced from the image carrier, wherein at least one of the pressing force input portion and the spacing force input portion comprises a terminal electrically connected to the memory element, and wherein the terminals are provided to both of the pressing force input portion and the spacing force input portion.

11. The developer cartridge according to claim 10, wherein the case holds the developer carrier at one end portion, wherein a grip member is swingably provided at another end portion opposite to the one end portion of the case, and wherein the pressing force input portion is formed on the grip member.

12. The developer cartridge according to claim 11, wherein the case comprises a first connecting portion to which the grip member is swingably attached, the first connecting portion formed of a conductive material and electrically connected to the memory element, and wherein the grip member comprises a second connecting portion attached to the first connecting portion of the case, the second connecting portion formed of a conductive material and electrically connected to the terminal.

13. The developer cartridge according to claim 12, wherein the pressing force input portion comprises the terminal, wherein the second connecting portion comprises: a shaft formed of a conductive material and electrically connected to the terminal, and wherein the first connecting portion comprises:

a shaft insertion portion configured to allow the shaft to be inserted; and a ring-shaped member formed of conductive material and provided in the shaft insertion portion so that the shaft is fitted to and rotatably supported by the ring-shaped member, the ring shaped-member electrically connected to the memory element.

14. The developer cartridge according to claim 13, wherein the second connecting portion comprises an elastic member having a fixed portion fixed to the grip member and a free portion unfixed to the grip member, and wherein the shaft extends from the free portion of the elastic member.

15. The developer cartridge according to claim 13, wherein the shaft comprises one or more protrusions integrally formed on an outer surface of the shaft, wherein the shaft is fitted to the ring-shaped member in a state where the protrusions contact an inner surface of the ring-shaped member.

16. The developer cartridge according to claim 15, wherein the inner surface of the ring-shaped member is formed of a conductive shrinkable material.

17. A developer cartridge removably mountable to an image forming apparatus having an image carrier, the developer cartridge comprising:

a developer carrier configured to supply developer to the image carrier;

a case that holds the developer carrier;

a memory element disposed in the case;

a pressing force input portion configured to receive pressing force to make the developer carrier contact the image carrier; and a spacing force input portion configured to receive spacing force to make the developer carrier be spaced from the image carrier, wherein at least one of the pressing force input portion and the spacing force input portion comprises a terminal electrically connected to the memory element, wherein the case that holds the developer carrier at one end portion;

wherein a grip member is swingably provided at another end portion opposite to the one end portion of the case; and wherein the pressing force input portion is formed on the grip member.

* * * * *